US005292010A

United States Patent [19]

Pickles et al.

[11] Patent Number: 5,292,010

[45] Date of Patent: Mar. 8, 1994

[54] DATA STORAGE MEDIA HOLDER SYSTEM AND METHOD THEREFORE

[75] Inventors: Timothy J. Pickles, Brighton; Macy J. Price, Jr., Louisville, both of Colo.

[73] Assignee: Engineered Data Products, Inc., Broomfield, Colo.

[21] Appl. No.: 986,103

[22] Filed: Dec. 4, 1992

[51] Int. Cl.[5] ..... A47F 5/00

[52] U.S. Cl. ..... 211/41; 211/40; 211/88

[58] Field of Search ..... 211/40, 41, 50, 55, 211/88

[56] References Cited

U.S. PATENT DOCUMENTS

| | | | |
|---|---|---|---|
| 2,742,161 | 4/1956 | Nuttall | 211/40 X |
| 3,190,242 | 6/1965 | Shelly | 211/50 X |
| 3,791,528 | 2/1974 | Brendgord | 211/88 |
| 4,034,864 | 7/1977 | Tyson et al. | 211/50 |
| 4,557,389 | 12/1985 | Williams et al. | 211/40 X |
| 4,684,027 | 8/1987 | Wright | 211/40 |

*Primary Examiner*—Robert W. Gibson, Jr.
*Attorney, Agent, or Firm*—Glenn L. Webb

[57] ABSTRACT

A media holder for securely holding various sizes of data storage media in a single holder. The media holder includes a rear wall, bottom surface and a plurality of spaced parallel flange portions extend inwardly from the rear wall and bottom surface to form compartments. Rear biasing members extend angularly across the rear wall of each of these compartments. Bottom biasing members extend angularly across the bottom surface of each of these compartments in approximately the same direction and same angle as the rear biasing members.

Data storage media, such as optical disk cases, are inserted into the compartments formed by the spaced flange portions. The angled surfaces of the rear and bottom biasing members bias the media against an adjacent flange portion. The line contact between the angled surfaces and media and the surface contact between the media and the adjacent flange portion will securely hold differing widths and sizes of media in the media holder.

9 Claims, 3 Drawing Sheets

DATA STORAGE MEDIA HOLDER SYSTEM AND METHOD THEREFORE

BACKGROUND OF THE INVENTION

1. Field of the Invention

The present invention relates to the field of data storage media holders, and particularly to the field of holders for optical disks.

2. Statement of the Problem

Information processing systems, such as mainframe computer systems, network computer systems, personal computers, require extensive data storage. This data storage is frequently required to be on media that can be easily transported and stored off-site. Data storage media is available in numerous styles and sizes of floppy disks, tape cartridges and optical disks. Data storage media is often stored in large quantities via rack systems. In order to expedite handling of these data storage media, such as optical disks, tape cartridges and the like, the media is handled by holders which can hold a plurality of media.

Typically, holders for such media are dedicated to a particular size of media. This is particularly a problem with optical disk storage. The packaging for optical disk varies, not only with differing sizes of optical disks, but also with different optical disk manufacturers. This also occurs with tape cartridges as well. Therefore it is very difficult to securely store such data storage media without dedicating particular holders for each size and each manufacturer of the data storage media.

Prior media holders are disclosed in U.S. Pat. No. 5,072,835, issued to Price, Jr. et al. U.S. Pat. No. 4,971,199, issued to Price, Jr. et al, U.S. Pat. No. 4,846,355, issued to Price, Sr. et al., and U.S. Pat. No. 4,844,564, issued to Price, Sr. et al. Each of these patents disclose a tape cartridge holder having compartments for storing tape cartridges. These tape cartridge holders all suffer from the above-described problems. Differing widths and sizes of media and associated packaging require either a single size of holder which can loosely hold differing sizes of media or differing sizes of holders each dedicated to a single size of media and/or packaging.

Thus a problem exists in providing secure storage for media having different sizes of packaging.

3. Solution to the Problem

The present invention solves this problem and others by providing a media holder for securely holding various sizes of data storage media in a single holder.

In a preferred embodiment of the present invention, a media holder includes a rear wall and bottom surface. A plurality of spaced parallel flange portions extend inwardly from the rear wall and bottom surface to form compartments for storing media, such as optical disk cases or data tape cartridges. Rear biasing members extend angularly across the rear wall of each of these compartments. Bottom biasing members extend angularly across the bottom surface of each of these compartments in approximately the same direction and same angle as the rear biasing members. In the preferred embodiment, the angle of each of the rear biasing members and bottom biasing members is about thirty (30) degrees.

Mounting hook members extend outwardly from an upper portion of the rear wall of the media holder. These hook members engage slots formed in supports of a rack system to mount the media holders on the rack system. A lower abutment member extends across a lower portion of the rear wall of the media holder. The lower abutment member extends outwardly a greater distance than the mounting hook members. Thus the engagement of the media holders with the supports of the rack system causes the media holders to tilt upward slightly.

Data storage media, such as optical disk cases, are inserted into the compartments formed by the spaced flange portions. Gravity, due to the slight upward tilt of the media holder, will cause the media to slide downward against the angled surfaces of the rear biasing members and the bottom biasing members. These angled surfaces will bias the media against an adjacent flange portion. The line contact between the angled surfaces and media and the surface contact between the media and the adjacent flange portion will securely hold differing widths and sizes of media in the media holder. Thus, almost any media having a width less than the width of the compartments can be stored in a single media holder.

The present invention solves this problem with other embodiments and variations. For instance, the angle and width of the rear biasing members and the bottom biasing members can be varied. Also, one of the rear biasing member or bottom biasing member could be omitted from each of the compartments. Different mounting systems could be used on the media holders to allow use on different storage systems. Additionally, the media holder could be used in a stand-alone configuration. Other embodiments and variations besides these are considered within the scope of the inventive concept.

The present invention will be more fully described in the detailed description of a preferred embodiment and the drawings.

DETAILED DESCRIPTION OF A PREFERRED EMBODIMENT

The present invention provides a media holder that accommodate differing widths and styles of media in a single holder. This holder, in the preferred embodiment can be easily adapted to mount in most existing rack systems and in other storage systems. Thus, the unique design of the present invention will allow relatively inexpensive storage of most data storage media since the expense of providing differing styles and sizes of holders and storage systems is eliminated.

A preferred embodiment of the present invention is illustrated in FIGS. 1–6. This particular embodiment is intended for storing optical disks. Optical disks presently are commonly provided in three one-half ($3\frac{1}{2}$) inch and five one-quarter ($5\frac{1}{4}$) inch formats. Additionally, the size of the packaging of these optical disks vary according to their source of manufacture. It is to be expressly understood that this descriptive embodiment is intended for explanatory purposes only. Other embodiments and variations are considered to be within the scope of the inventive concept.

Figure 1:
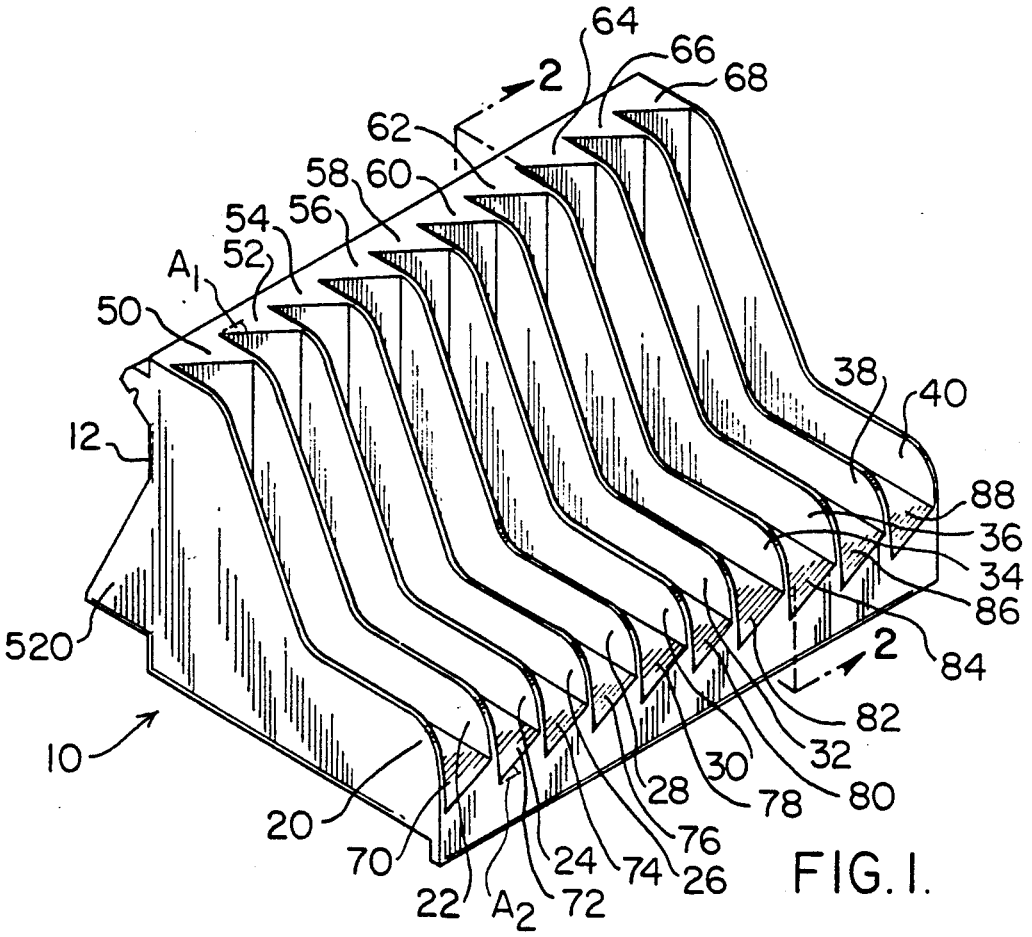
FIG. 1 is a perspective view of a preferred embodiment of the holder of the present invention.

Media holder 10, shown in FIG. 1, is designed to hold up to ten optical disk cases. Media holder 10 includes rear wall 12 and bottom surface 14. Flange portions 20–40 extend inwardly from rear wall 12. Flange portions 20–40, in this embodiment, are spaced apart about one inch from one another to form compartments for the optical disk cases. This spacing is determined solely on considerations of the desired width of media holder and the desired number of compartments. Media holder 10 of this particular embodiment is intended for use with the Extreme Density Storage Rack System TM, manufactured by Engineered Data Products, Inc., Broomfield, Colo.

Rear biasing member 50 extends angularly from rear wall 12 of media holder between flange portions 20, 22. Angle $A_1$ of rear biasing member 52 between the flange portions can range between about one degree to about ninety degrees. In the preferred embodiment, angle $A_1$ is about thirty degrees. Preferably, this angle is between twenty and sixty degrees. Also, in this embodiment, rear biasing member 50 extends the full width between flange portions 20, 22. In other embodiments under the present invention, rear biasing member 50 can extend across only part of the width between flange portions 20, 22. Also, in this embodiment, rear biasing member 50 extends substantially the full height of rear wall 12. In other embodiments, rear basing member can extend only part of this height. Rear biasing members 52–68 similarly extend from rear wall 12 between spaced flange portions 22–40, respectively.

Figure 2:
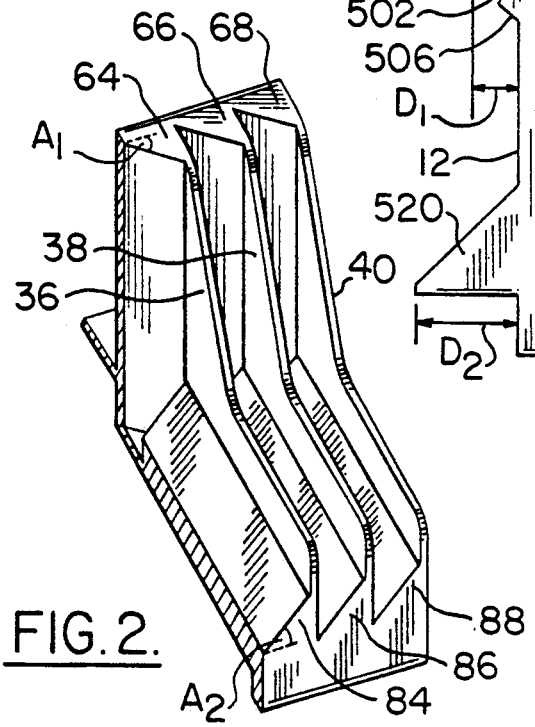
FIG. 2 is a front perspective of the holder of the FIG. 1.

Bottom biasing member 70, shown in FIG. 2, extends angularly across bottom surface 14 of media holder 10 between flange portions 20, 22. Angle $A_2$ of bottom biasing member 70 is similar to angle $A_1$ of rear biasing member 50. In this embodiment, angle $A_2$ is about thirty degrees. Additional biasing members 72–88 similarly extend across bottom surface 14 between spaced flange portions 22–40. Likewise, the angle and width of bottom biasing members 70–88 can be varied similar to rear biasing members 50–68.

Media holder 10, rear biasing members 50–68 and bottom biasing members 70–88, in the preferred embodiment, are formed of plastic. Other materials and methods of forming media holder and members are considered to be within the scope of this invention.

Figure 3:
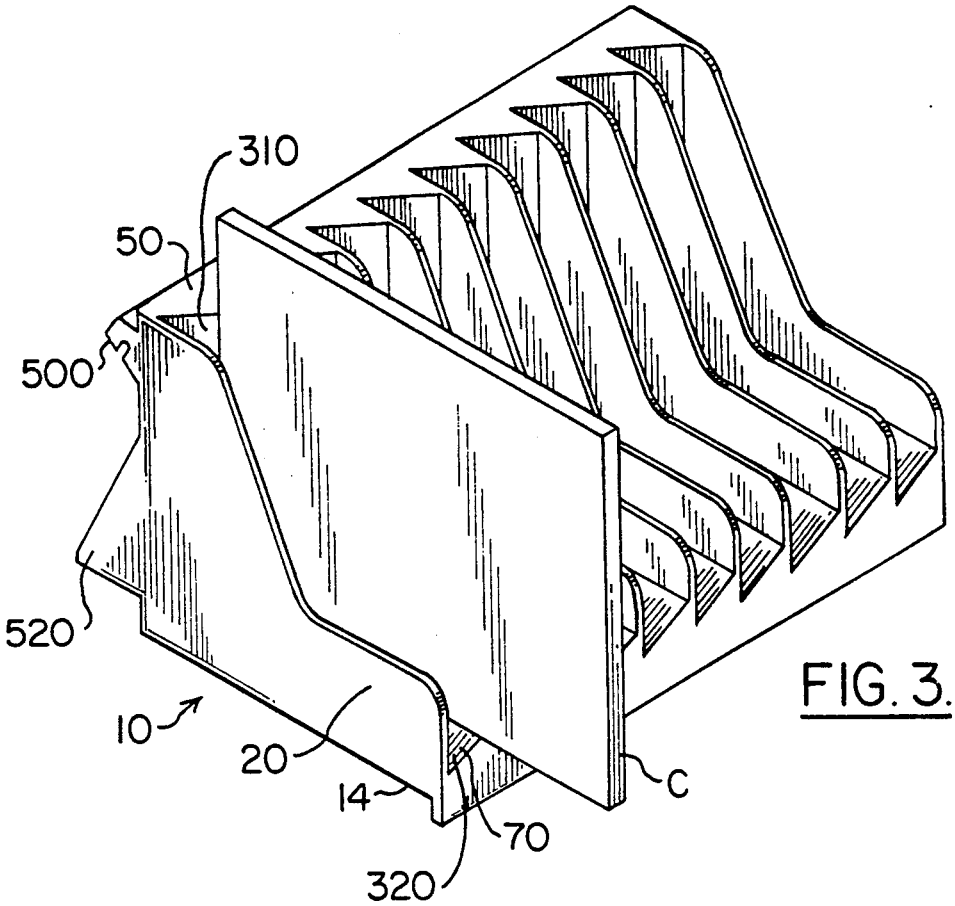
FIG. 3 is a view of an optical disk case partially inserted into a compartment of the holder of FIG. 1.
Figure 4:
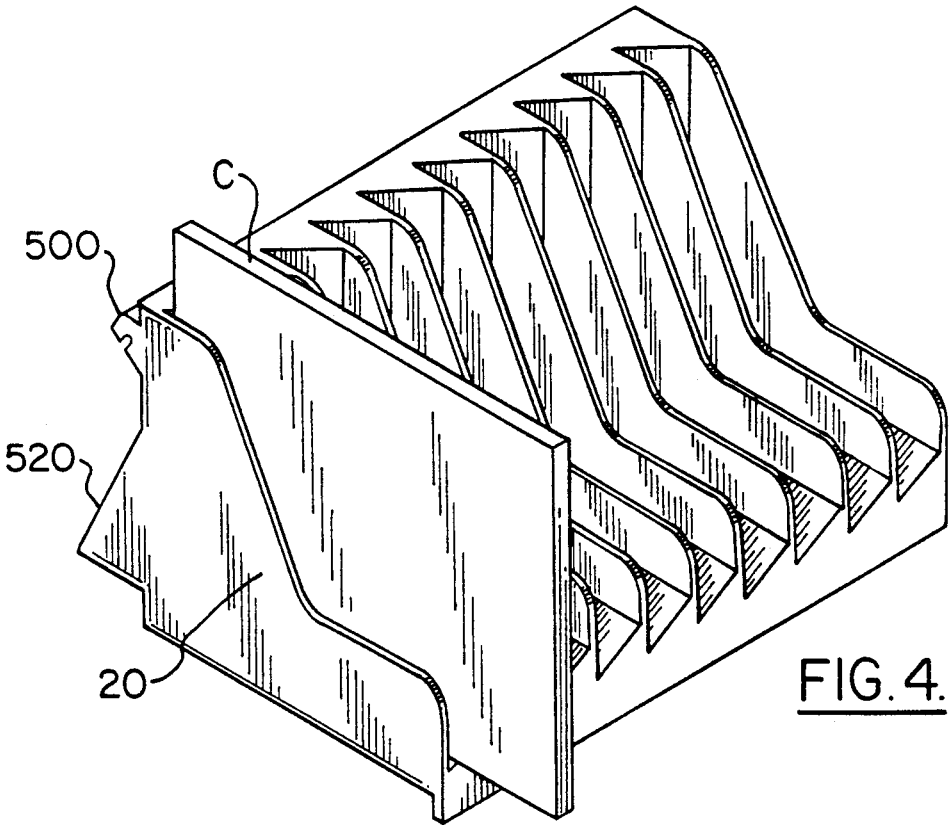
FIG. 4 is a view of an optical disk case fully inserted into the compartment of the holder of FIG. 1.
Figure 6:
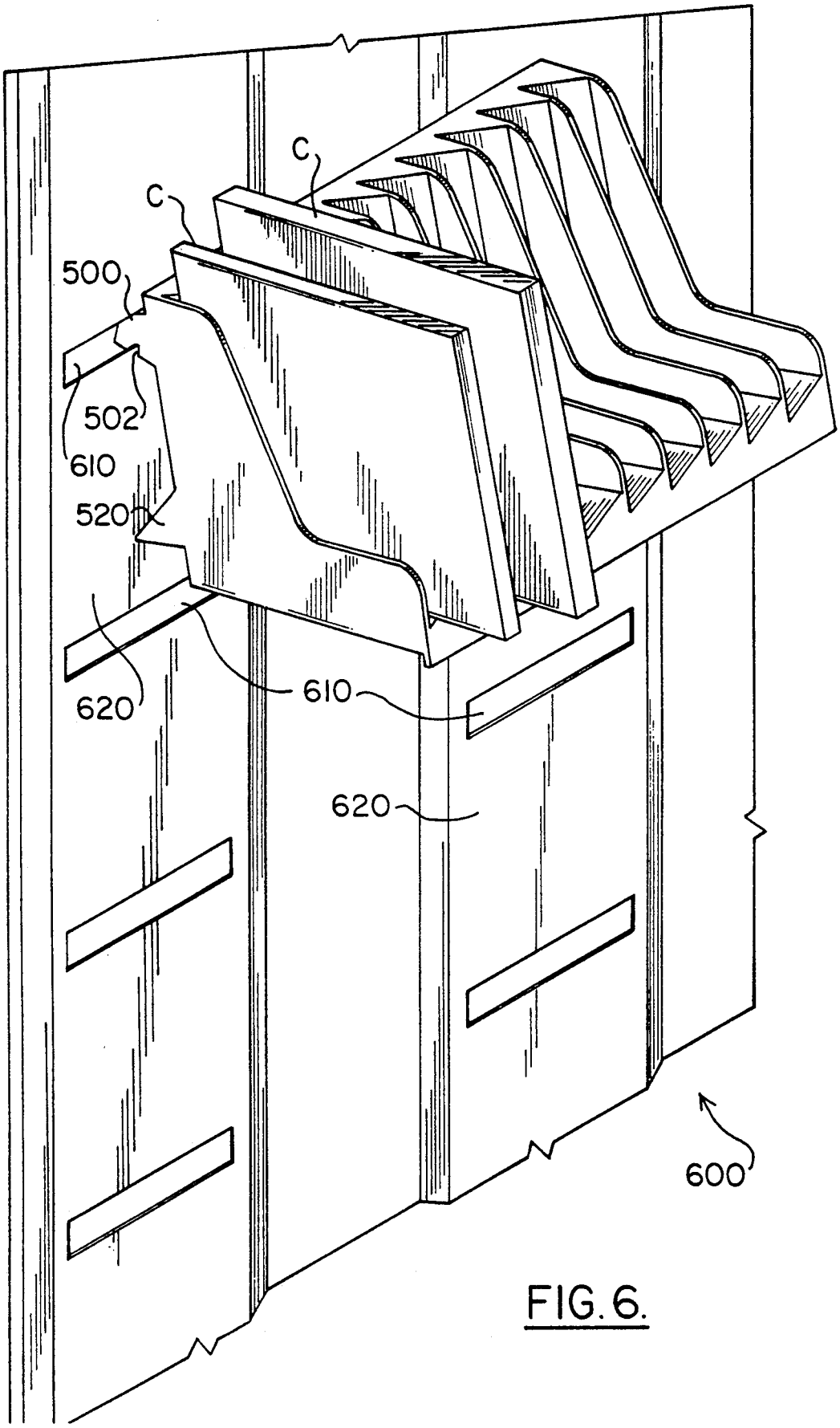
FIG. 6 is a perspective view of the holder mounted on a rack system.

Rear biasing members 50–68 and bottom biasing members 70–88 are designed to bias data storage media against the adjacent flange portion. This enables differing widths of data storage media to be stored in media holder 10. An example of this feature is illustrated in FIGS. 3 and 4. Optical disk case C is partially inserted into the compartment formed between flange portions 20, 22. Optical disk case C is inserted so that it contacts angled surface 310 of bottom biasing member 70 and angled surface 320 of rear biasing member 50. As optical disk case is further inserted, angled surfaces 300, 310 "push" or biases optical disk case C toward flange portion 20. Once optical disk case C, as shown in FIG. 4, is fully inserted between flange portions 20, 22, it is fully biased against flange portion 20. The line contact between optical disk case C and angled surfaces 310, 320 securely holds optical disk case C in media holder 10.

The biasing performance of angled surfaces 310, 320 against optical disk case C enables widths of optical disk cases up to width of the spacing between the flange portions to be securely held in media holder 10. The line contact of the angled surfaces bias the optical disk cases against the adjacent flange portion to securely hold the optical disk case in the media holder.

Figure 5:
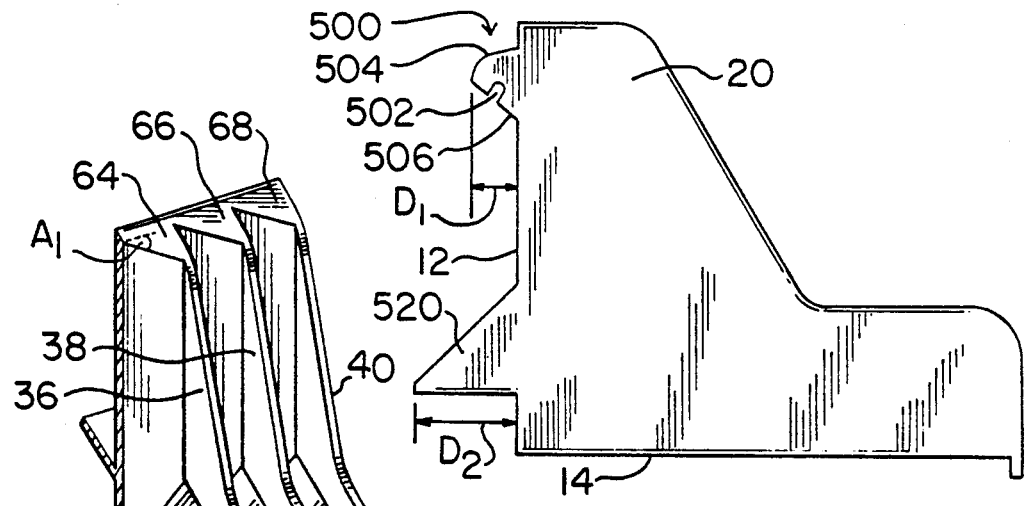
FIG. 5 is a side view showing the rear attachment mechanism of the holder of FIG. 1.

In the preferred embodiment, media holder 10 includes identical hook members 500, 510 extending outwardly distance $D_1$ from rear wall 12 of media holder 10. Hook member 500 is shown in FIG. 5. Hook member 500 is formed of molded plastic to be resilient. Hook member 500 has an angularly upwardly extending slot 502, radiused upper portion 504 and angled lower surface 506. Hook members 500, 510 are designed to be inserted into slots of a rack system as described below.

Lower abutment member 520 extend outwardly from a lower portion of rear wall 12 of media holder 10. Lower abutment member 520, shown in FIG. 5, extends outwardly distance $D_2$ which is greater than distance $D_1$ of rear hook members 500, 510. This causes media holder 10 to angle upward so optical disk cases will be held by gravity in the compartments formed by the spaced flange portions. In the preferred embodiment the difference between $D_1$ and $D_2$ is about 0.15 inches and the vertical spacing between hook members 500, 510 and lower abutment member 520 is four (4) inches. This provides about fifteen (15) degrees of tilt when media holder 10 is mounted on a rack system.

Media holder 10 is easily mounted on rack systems, such as the Extreme Density Storage Rack System TM described above. Rear hook members 500, 510 are inserted into slots on support members of these racks. The engagement between lower abutment member 520 with the support members provide an upward tilt to media holder 10. Optical disk cases inserted between spaced flange portions are biased by gravity against rear biasing members 50–68 and bottom biasing members 70–88 which in turn bias the optical disk cases against an adjacent flange portion. Thus, differing widths of optical disk cases are securely held in media holder 10.

Although the preferred embodiment was described for use with optical disk cases, other forms of data storage media can be stored in appropriately dimensioned media holders. For instance, 3480/3490 style tape cartridges, eight millimeter and four millimeter tape cartridges can be easily stored in an appropriately dimensioned media holder under the present invention.

It is to be expressly understood that other embodiments and variations of the present invention are within the scope of the inventive concept. For instance, the angle of the biasing members can be varied as well as the widths, heights and lengths of the biasing members. Also, either the rear biasing member or the bottom biasing member can be omitted. Additionally, the rear mounting mechanism can be varied or omitted according to the desired use of the media holders. The dimensions and material choice of the media holder and the compartments formed therein can be varied as necessary or desired.

The invention as presently claimed sets forth media holders for securely holding differing widths of data storage media.

We claim:

1. A holder for storing data storage media, said holder comprising:

a rear wall;

a bottom surface;

a first flange portion extending inwardly from said rear wall;

a second flange portion spaced from said first flange portion and extending inwardly from said rear wall;

said first flange portion and said second flange portion forming a compartment for data storage media; and a first member adjacent said rear wall between said first flange portion and said second flange portion and angled away from said rear wall and said first flange portion to guide data storage media inserted between said first flange portion and said second flange portion towards said first flange portion for securely holding differing widths of data storage media between said first flange portion and said second flange portion.

2. The holder of claim 1 wherein said angle of said first member is greater than zero (0) degrees and less than ninety (90) degrees from said rear wall.

3. The holder of claim 1 wherein said holder further includes:

a second member adjacent said bottom surface between said first flange portion and said second flange portion and angled away from said bottom surface and said first flange portion to guide data storage media inserted between said first flange portion and said second flange portion towards said first flange portion.

4. The holder of claim 3 wherein said angle of said second member ranges between 1 degree and 89 degrees from said bottom surface.

5. The holder of claim 1 wherein said holder further includes:

means extending from said rear wall for engagement with a rack system.

6. The holder of claim 1 wherein said holder further includes:

means extending from said rear wall for engagement with a rack system; and said engagement means tilt said bottom surface and said rear wall.

7. The holder of claim 1 wherein said holder further comprises a plurality of flange portions spaced from one another forming compartments to hold a plurality of data storage media; and one of said first members in each of said compartments for securely holding differing widths of data storage media between said plurality of flange portions.

8. A method of storing differing sizes of media in a media holder having compartments with at least one surface adjacent the rear wall of each of said compartments and angled away from the rear wall formed therein, said method comprising the steps of:

(a) inserting media in a compartment of the media holder;

(b) engaging the media with the angled surface on the rear wall in the compartment;

(c) biasing the media against one side of the compartment by the engagement of the media with said rearwardly angled surface.

9. The method of claim 8 wherein said holder further includes providing a bottom member having a surface angled towards said first side of the compartment; and step (c) further includes:

biasing the media against said first side of the compartment of the engagement of the media with said rear member angled surface and said bottom member angled surface.

* * * * *